US006923737B1

(12) United States Patent
Walker

(10) Patent No.: US 6,923,737 B1
(45) Date of Patent: Aug. 2, 2005

(54) BASEBALL SWING TRAINING APPARATUS

(76) Inventor: Keith Walker, 563 N. 88th Plaza, Apt. 11A, Omaha, NE (US) 68123

( * ) Notice: Subject to any disclaimer, the term of this patent is extended or adjusted under 35 U.S.C. 154(b) by 0 days.

(21) Appl. No.: 10/426,056

(22) Filed: Apr. 29, 2003

Related U.S. Application Data

(60) Provisional application No. 60/376,513, filed on Apr. 30, 2002.

(51) Int. Cl.[7] ..... A63B 69/00
(52) U.S. Cl. ..... 473/457; 473/422; 473/453; 473/564
(58) Field of Search ..... 473/457, 422, 473/527, 558–568

(56) References Cited

U.S. PATENT DOCUMENTS 2,237,748 A * 4/1941 Schwarzenzer ..... 273/109
3,111,314 A * 11/1963 Topper ..... 473/457
3,115,129 A * 12/1963 Merriman ..... 124/5
3,115,342 A * 12/1963 Webster ..... 473/457
3,214,168 A * 10/1965 Sauber ..... 473/567
3,496,924 A * 2/1970 Miller ..... 124/5
5,133,551 A * 7/1992 Handy et al. ..... 473/567
5,590,875 A * 1/1997 Young ..... 473/457
6,241,629 B1 * 6/2001 Otto ..... 473/457
6,461,163 B1 * 10/2002 Gallagher et al. ..... 434/252
6,565,462 B1 * 5/2003 Gregg ..... 473/457

* cited by examiner

*Primary Examiner*—Mitra Aryanpour
(74) *Attorney, Agent, or Firm*—Suiter West PC LLO

(57) ABSTRACT

A baseball swing training apparatus including that enables a batter to determine whether his swing followed the proper principles for hitting or batting. Oriented for use by both right-handed and left-handed batters it is intended to teach batters how their wrists should react in order to most effectively hit a ball. This generally baseball bat shaped apparatus includes a swing indicator disposed inside the barrel, which impacts one of four impact points producing an audible response when a swing is performed correctly. An incorrect swing produces no audible response.

11 Claims, 5 Drawing Sheets

BASEBALL SWING TRAINING APPARATUS

CROSS-REFERENCE TO RELATED APPLICATIONS

The present application claims priority under 35 U.S.C. 119(e) of U.S. Provisional Patent Application No. 60/376,513, filed Apr. 30, 2002, entitled "BASEBALL SWING TRAINING APPARATUS." Said U.S. Provisional Patent Application No. 60/376,513 is herein incorporated by reference in its entirety.

FIELD OF THE INVENTION

The present invention generally relates to the field of baseball and softball training devices, and more particularly, to a baseball swing training apparatus for indicating the correct or incorrect swing of a batter through the heart of the strike zone.

BACKGROUND OF THE INVENTION

Baseball has been known and loved for at least 150 years. In this time, many new devices have been devised to improve pitching, catching and most importantly batting. These batting devices have been utilized to increase the strength of the batter, the bat speed, and improve the hand/eye coordination and hand/wrist motion during the swing of the batter. This particular device is designed to indicate whether or not a batter is swinging the bat correctly.

The path a bat travels during a swing by a batter may vary from swing to swing. However, in a correct swing, the batter strives to roll or rotate the top hand over the bottom hand (with respect to the grip of the bat). This movement is commonly referred to as "breaking the wrists" and is performed immediately before, during and through contact with a baseball or other such object. The batter "breaks his wrist" to follow through the forward motion of his or her swing, making contact with the ball and resulting in an optimal amount of force being applied to the baseball as well as control over the direction the baseball is hit.

In an incorrect swing, the batter has a tendency to prematurely release the top hand from the bat during the swing, or alternatively, to rotate the top hand over the bottom hand prematurely. This is considered a bad habit by most batting coaches. The premature release of the bat by the top hand limits the control the batter has over where the ball is hit into the field. Likewise, the premature rotation of the bat by the batter usually results in the ball being hit downward. In either case, the improper swing typically results in a ball hit in an unintended direction and without much power.

It is therefore desirable to provide a baseball swing training apparatus which will readily disclose to the batter whether or not he is swinging a bat in accordance with the proper principles for batting. A still further object of this apparatus is to provide a useful device for developing the swing of a batter that is economical to manufacture and use.

SUMMARY OF THE INVENTION

Accordingly, the present invention is directed to a baseball or softball swing training apparatus that allows a batter to consistently practice proper hitting mechanics and obtain immediate feedback as to whether or not he was utilizing proper or improper hitting mechanics.

In exemplary embodiments, the baseball swing training apparatus of the present invention includes a bat with a swing indicator disposed inside the barrel. The swing indicator has an end guide that follows one of two paths. A contact is attached to the end of one of two paths to disclose to the batter that the batting swing was correct or incorrect.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description serve to explain the principles of the invention.

BRIEF DESCRIPTION OF DRAWINGS

The numerous advantages of the present invention may be better understood by those skilled in the art by reference to the accompanying figures in which.

DETAILED DESCRIPTION

Reference will now be made in detail to the presently preferred embodiments of the invention, examples of which are illustrated in the accompanying drawings.

Figure 1:
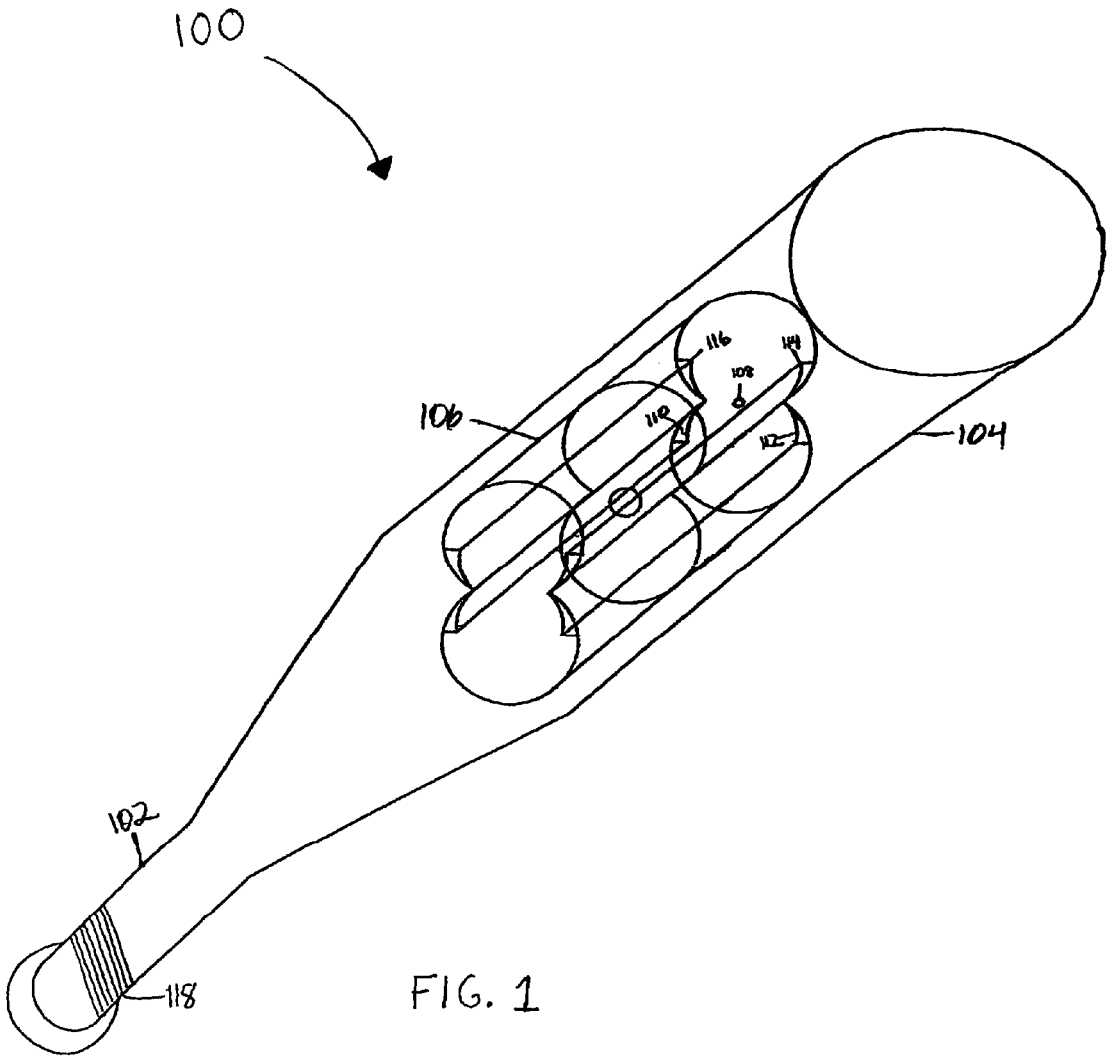
FIG. 1 is an isometric view illustrating a baseball bat disposed with the baseball swing training apparatus in accordance with an exemplary embodiment of the present invention.
Figure 2A:
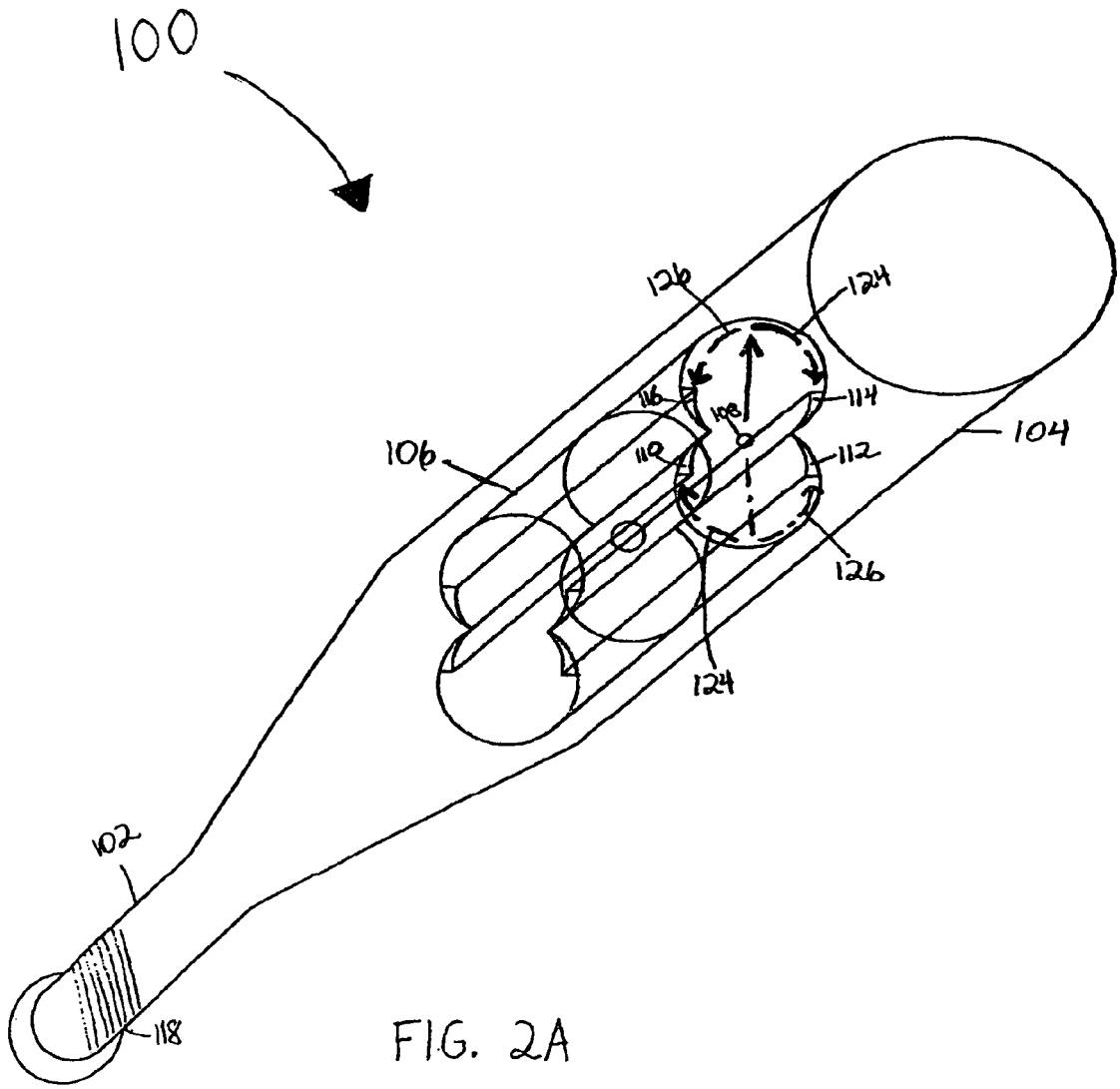
FIG. 2A is an isometric view illustrating the baseball swing training apparatus shown in FIG. 1 wherein a schematic representation of the paths of a correct swing are shown.
Figure 2B:
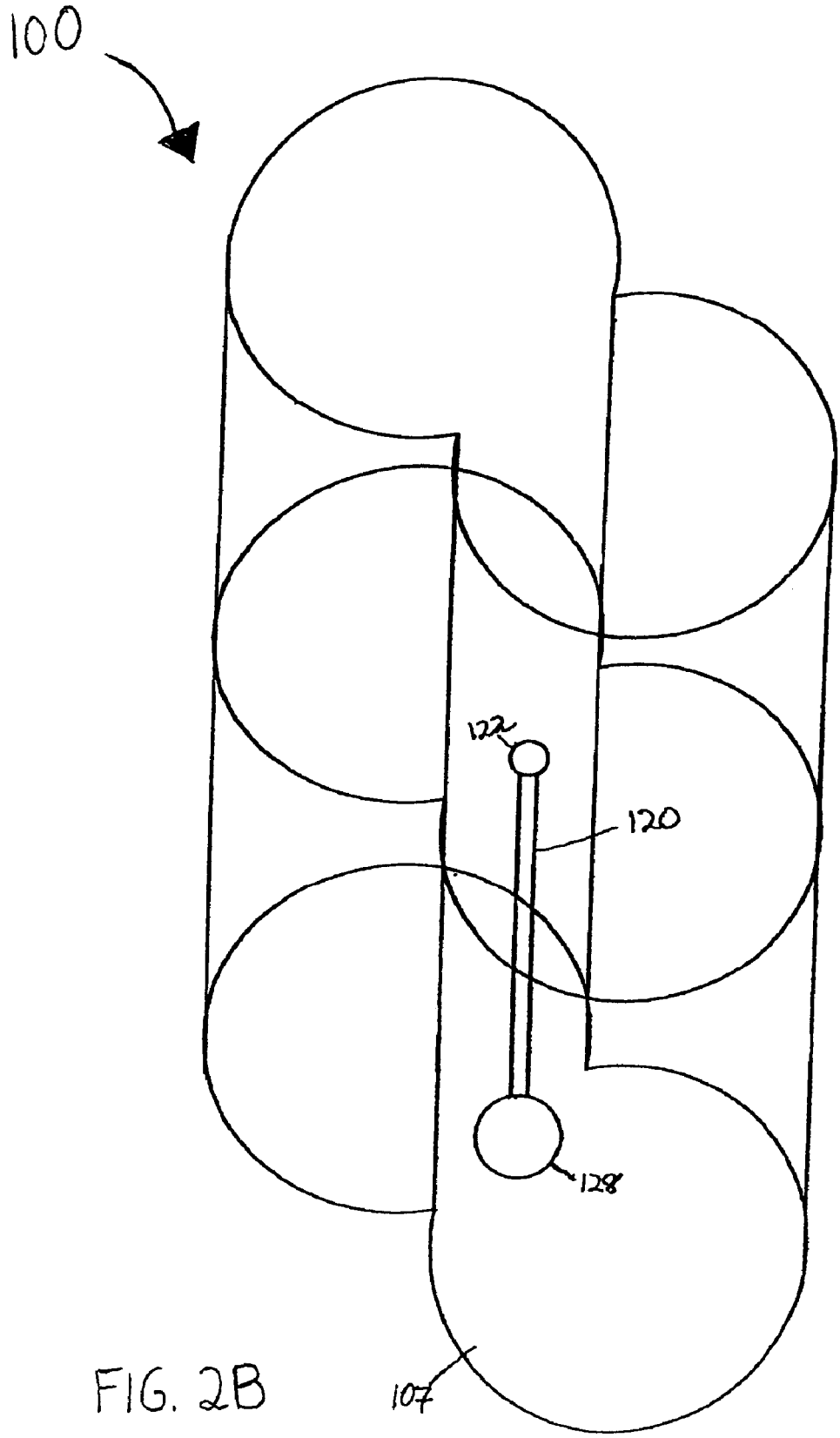
FIG. 2B is an isometric view illustrating the attachment of a swing indicator within the cylinder of the baseball swing training apparatus.

Referring now to FIGS. 1, 2A and 2B, a baseball or softball swing training apparatus 100 in accordance with an exemplary embodiment of the present invention is described. baseball swing training apparatus 100 includes a handle 102, a barrel 104, a cylinder 106 disposed within barrel 104, a swing indicator 108 disposed inside cylinder 106. Cylinder 106 further includes impact points 110, 112, 114 and 116. Baseball swing training apparatus 100 is composed of metal such as aluminum and the like or may be composed of wood. Barrel 104 extends outwardly beyond the length of handle 102. Handle 102 includes a grip 118, which acts as a guide for the batter to place both hands into the desired hitting position giving baseball swing training apparatus 100 the proper orientation during the swing. Grip 118 may have a variety of visual indicators attached through a process such as adhering, printing, painting and the like. The visual indicators may be a piece of tape, a symbol or any other suitable label or sign for providing visual indication of proper orientation. Baseball swing training apparatus 100 is oriented for use by both a right-handed batter and a left-handed batter.

In exemplary embodiments, cylinder 106 comprises a hollow enclosure that is suspended within barrel 104. Preferably, cylinder 106 has a cross-section generally comprising a hollow figure eight. It is contemplated that cylinder 106 may be shaped as a hollow circular enclosure. Such a circular enclosure may provide increased integrity strength for baseball swing training apparatus 100, while still allowing both right-handed and left-handed hitters to utilize the apparatus. Further, cylinder 106 may be isolated entirely within barrel 104 or may extend through the length of barrel 104 and connect with handle 102.

FIG. 2A illustrates a first path 124 and a second path 126, which are generally an arch pattern that the swing indicator may follow when the batter swings as a right-handed batter or as a left-handed batter. The path swing indicator 108 follows depends on the swing the batter executes. For example, if the batter swings the bat correctly, i.e. the batter rotates his swing to "break his wrist" by rolling or turning the top hand over the bottom hand during the swing, swing indicator 108 will follow the path established as correct. When this occurs swing indicator 108 impacts one of swing indicator impact points 110, 112, 114 and 116, verifying that a correct swing has been performed. If the batter swings the bat incorrectly, i.e. the batter does not "break his wrist" by rolling the top hand over the bottom hand, but releases his top hand prematurely or too late, the swing indicator will follow the path established as incorrect. The result is that swing indicator 108 will not impact one of swing indicator impact points 110, 112, 114 and 116.

Swing indicator impact points 110, 112, 114 and 116 rest at both ends of one of first path 124 and second path 126 to allow both right-handed batters and left-handed batters to utilize baseball swing training apparatus 100. Swing indicator impact points 110 through 116 are generally rectangular plates, which curve to follow the shape of cylinder 106 and form a smooth connection. The plates are composed of a durable material such as steel, aluminum and the like. One length of each swing indicator impact point 110 through 116 projects upwardly beyond the surface of cylinder 106. Preferably, as the batter swings baseball swing training apparatus 100 swing indicator 108 follows one of first path 124 and second path 126 and hits the ends of one of the swing indicator impact points 110 through 116, that extends upwardly beyond the surface of cylinder 106.

Being composed of metal the plates, which comprise the ends of impact points 110 through 116, when contacted produce an audible response. In this manner, the correctness or incorrectness of the swing can be imparted through resonation from the impact of the swing indicator 108 on one of the impact points 110 through 116. In another embodiment the impact points 110 through 116, upon impact by the swing indicator, may send an electrical signal to provide verification of a correct swing. The electrical signal may produce a sound such as a buzzer, a bell, a ringer and the like or may even provide some form of visual indication. Other verification methods may be employed as contemplated by one of ordinary skill in the art without departing from the spirit and scope of the present invention.

FIG. 2B illustrates swing indicator 108 comprised of a spring 120 having an end guide portion 122. End guide portion 122 is generally metal and may be a variety of shapes, such as, round, oval, rectangular and the like. Before or after a swing of baseball swing training apparatus 100, spring 120 is sufficiently firm, to keep the swing indicator 108 at equilibrium within barrel 104. However, spring 120 is sufficiently flexible, so that it may follow a first path 124 or a second path 126 when the batter swings the baseball swing training apparatus 100.

Swing indicator 108 is connected to a first end 107 of cylinder 106. The connection of spring 120, of swing indicator 108, with first end 107 of cylinder 106 is accomplished via an attachment assembly 128 such as, a hook, a rivet and the like, or even may be integrated with first end 107 through processes such as welding, sodering and the like. It is contemplated that if cylinder 106 extends to connect with handle 102 that swing indicator 108 may connect to handle 102 via an attachment assembly as substantially described above.

Figure 3:
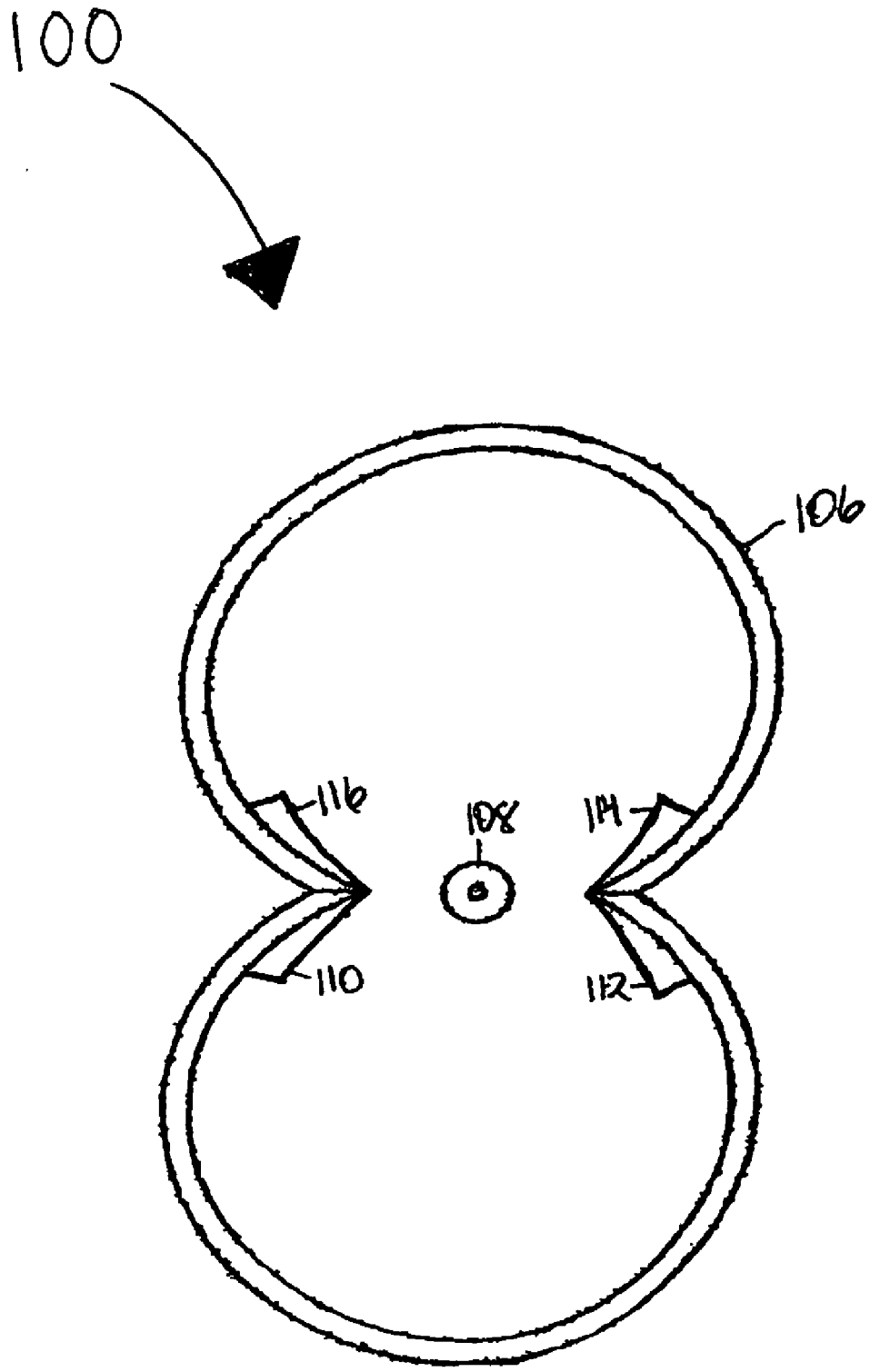
FIG. 3 is a front view of the baseball swing training apparatus shown in FIG. 2 wherein the swing indicator is at equilibrium.

As shown in FIG. 3, swing indicator 108 generally sits at equilibrium in the center of cylinder 106. From this equilibrium position, swing indicator 108 may follow the first path 124 or the second path 126 to indicate a correct swing. The baseball swing training apparatus 100 provides an audible response following the correct swing, indicating to the user that the swing was correct. However, if the user performs a swing which is incorrect, then swing indicator 108 will not follow path 124 or path 126 and will not impact one of the impact points 110 through 116. The user will be aware of the incorrect swing by the absence of the audible response which follows a correct swing.

Figure 4:
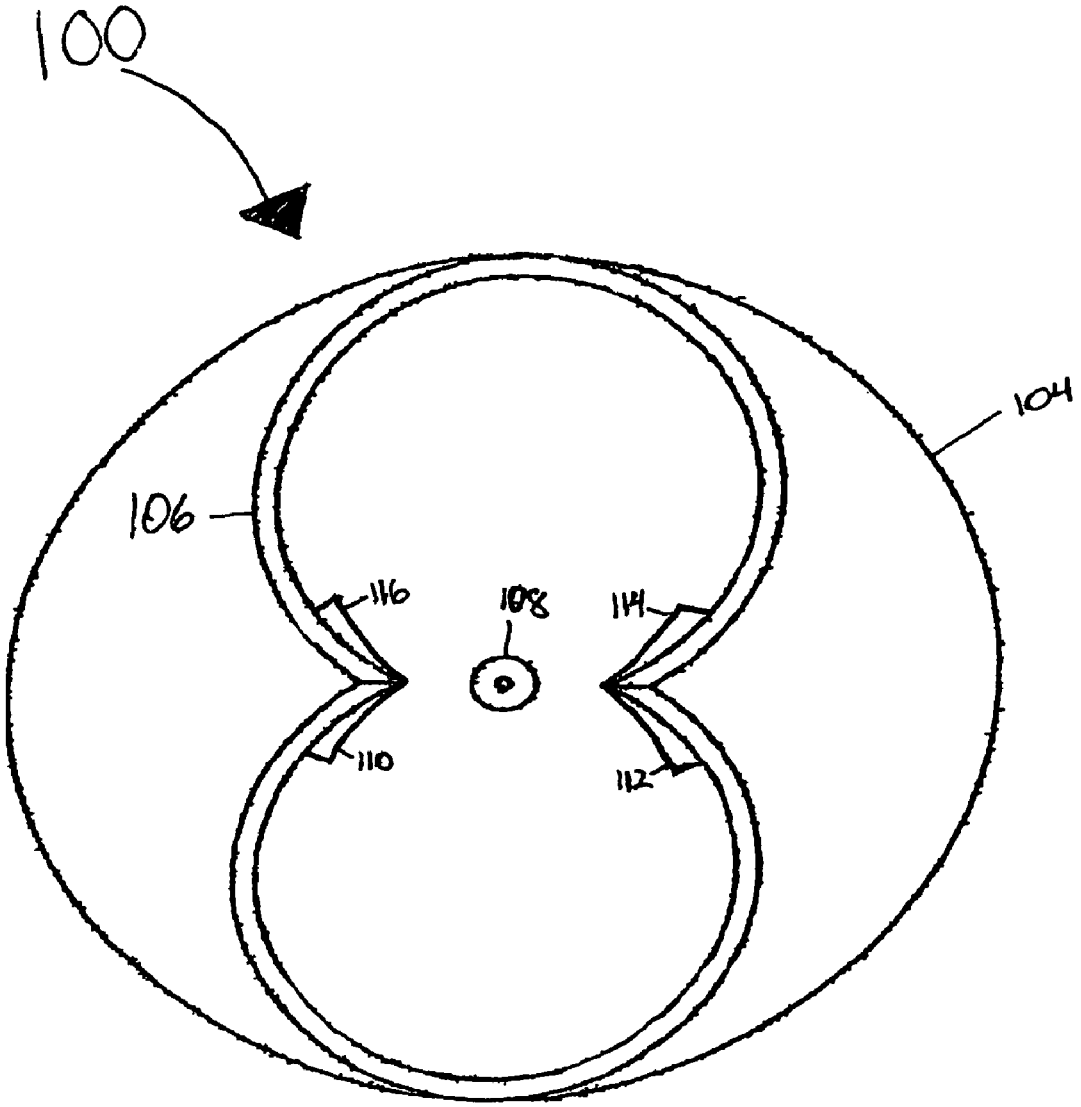
FIG. 4 illustrates the cylinder suspended in the barrel in accordance with an exemplary embodiment of the present invention.

As shown in FIG. 4, barrel 104 suspends cylinder 106 within. This may be accomplished by filling the space around cylinder 106 with a fluid, a lubricant, or a bearing assembly and the like. Thus, cylinder 106 may rotate in order to place swing indicator 108 in the correct position to properly verify a correct or incorrect swing. For example, if the batter picks up baseball swing training apparatus 100 and impact points 110 through 116 are in a position where if the batter executed a correct swing, swing indicator 108 would not impact one of the impact points 110 through 116 then swing indicator 108 would place force upon the interior sides of the plates, which provide impact points 110 through 116, and rotate cylinder 106. The rotation of cylinder 106 is necessary so that when the batter executes a correct swing, baseball swing training apparatus 100 will verify a correct swing by producing the audible response as described above. When the batter executes an incorrect swing, baseball swing training apparatus 100 will verify an incorrect swing by not producing the audible response, which indicates a correct swing.

In the foregoing discussion, a swing training apparatus 100 suitable for use in baseball or softball is described. However, it will be appreciated that the swing training apparatus 100 of the present invention may be utilized in other sports which employ a bat, racket or the like, swung in a manner similar to that in baseball or softball.

It is believed that the baseball swing training apparatus of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form, construction and arrangement herein before described being merely an explanatory embodiment thereof. It is the intention of the following claims to encompass and include such changes.

What is claimed is:

1. A swing training apparatus, comprising:

a bat including a barrel having a cylinder disposed therein;

a swing indicator disposed within the cylinder, the swing indicator including an end guide for following a predetermined path within the cylinder when the bat is swung correctly by a user of the baseball swing training apparatus; and a contact attached to an end of the path, the contact being impacted by the end guide when the bat is swung correctly by the user;

wherein the contact includes a plurality of spaced plates attached along the length of said cylinder which curve to follow the shape of the cylinder;

wherein the impact of the end guide and the contact causes an audible indication to be provided to the user for informing the user if the swing was correct or incorrect.

2. The swing training apparatus of claim 1, wherein plate material is steel.

3. The swing training apparatus of claim 1, wherein plate material is aluminum.

4. The swing training apparatus of claim 1, wherein the plates are rectangular shaped.

5. The swing training apparatus of claim 1, wherein the cylinder includes a cross-section shaped as a hollow figure eight.

6. The swing training apparatus of claim 1, wherein the cylinder includes a cross-section shaped as a hollow circle.

7. A swing training apparatus, comprising:

a bat including a barrel having a cylinder disposed therein;

a swing indicator disposed within the cylinder, the swing indicator including an end guide for following a predetermined path within the cylinder when the bat is swung correctly by a user of the baseball swing training apparatus; and a contact attached to an end of the path, said contact including multiple rectangular plates which curve to follow the shape of the cylinder; the contact being impacted by the end guide when the bat is swung correctly by the user;

wherein the impact of the end guide and the contact causes an audible indication to be provided to the user for informing the user if the swing was correct or incorrect.

8. The swing training apparatus of claim 7, wherein plate material is steel.

9. The swing training apparatus of claim 7, wherein plate material is aluminum.

10. The swing training apparatus of claim 1, wherein the cylinder includes a cross-section shaped as a hollow figure eight.

11. The swing training apparatus of claim 1, wherein the cylinder includes a cross-section shaped as a hollow circle.

* * * * *